US008410715B2

(12) United States Patent
Jeong et al.

(10) Patent No.: US 8,410,715 B2
(45) Date of Patent: Apr. 2, 2013

(54) METHOD OF DRIVING LIGHT SOURCES, DEVICE FOR DRIVING LIGHT SOURCES, AND DISPLAY DEVICE HAVING THE SAME

(75) Inventors: Jae-Won Jeong, Seoul (KR); Yong-Jun Choi, Cheonan-si (KR); Bong-Im Park, Cheonan-si (KR); Bong-Ju Jun, Cheonan-si (KR); Woo-Young Lee, Daegu (KR)

(73) Assignee: Samsung Display Co., Ltd. (KR)

( * ) Notice: Subject to any disclaimer, the term of this patent is extended or adjusted under 35 U.S.C. 154(b) by 655 days.

(21) Appl. No.: 12/203,849

(22) Filed: Sep. 3, 2008

(65) Prior Publication Data

US 2009/0184664 A1 Jul. 23, 2009

(30) Foreign Application Priority Data

Jan. 22, 2008 (KR) ..... 10-2008-0006486

(51) Int. Cl.
*H05B 37/00* (2006.01)

(52) U.S. Cl. ..... 315/291

(58) Field of Classification Search ..... 315/291–297, 315/312; 345/102
See application file for complete search history.

(56) References Cited

U.S. PATENT DOCUMENTS 6,559,826 B1 * 5/2003 Mendelson et al. ..... 345/102
2005/0099144 A1 * 5/2005 Sanchez ..... 315/312
2005/0116662 A1 * 6/2005 Sanchez ..... 315/225
2006/0049781 A1 * 3/2006 Lee et al. ..... 315/312
2006/0049782 A1 * 3/2006 Vornsand et al. ..... 315/312
2006/0152468 A1 * 7/2006 Ozaki ..... 345/102
2006/0187181 A1 * 8/2006 Kim ..... 345/102
2006/0220571 A1 * 10/2006 Howell et al. ..... 315/86
2007/0115228 A1 * 5/2007 Roberts et al. ..... 345/82
2007/0268236 A1 * 11/2007 Morrow ..... 345/102
2008/0174607 A1 * 7/2008 Iranli ..... 345/589
2011/0285758 A1 * 11/2011 Matsushita ..... 345/690

* cited by examiner

*Primary Examiner* — Douglas W Owens
*Assistant Examiner* — Amy Yang
(74) *Attorney, Agent, or Firm* — Innovation Counsel LLP

(57) ABSTRACT

One or more embodiments of the present disclosure provide a method for driving light sources, a device for driving light sources and a display device having the device for driving the light sources. Power information is read based on position information on the light sources to output a light source control signal transmitting the power information. The power information determines a level of power applied to each of the light sources. Externally provided input power is changed into a plurality of driving powers having a level changed based on the light source control signal. The driving powers are applied to the light sources, respectively. According to one aspect of the present disclosure, uniformity of luminance distribution of a display panel may be improved.

20 Claims, 10 Drawing Sheets

METHOD OF DRIVING LIGHT SOURCES, DEVICE FOR DRIVING LIGHT SOURCES, AND DISPLAY DEVICE HAVING THE SAME

CROSS-REFERENCE TO RELATED APPLICATIONS

The present application claims priority under 35 U.S.C. §119 to Korean Patent Application No. 2008-6486, filed on Jan. 22, 2008 in the Korean Intellectual Property Office (KIPO), the contents of which are incorporated herein by reference in their entirety.

BACKGROUND

1. Technical Field

The present invention relates to a method of driving light sources, a device for driving light sources and a display device having the device for driving the light sources. More particularly, the present invention relates to a method of driving light sources used for a flat panel display device, a device for driving light sources and a display device having the device for driving the light sources.

2. Description of the Related Art

Electronic devices, such as flat panel display devices, have been developed with strong mechanical strength, low driving voltage, low power consumption, small size, thin thickness and light weight. A liquid crystal display (LCD) device is a type of flat panel display device that has these various characteristics. Also, the LCD device has high display quality substantially similar to a cathode ray tube (CRT) display device. In the recent past, the LCD device has been widely used in various fields.

Some backlight assemblies utilized in LCD devices include a direct illumination type backlight assembly or an edge illumination type backlight assembly. The direct illumination type backlight assembly includes a plurality of light sources under a display panel. The edge illumination type backlight assembly has a light source adjacent to a side surface of a light guide plate to supply the display with light. The light source may include a cold cathode fluorescent lamp (CCFL). The CCFLs of the direct illumination type backlight assembly may be grouped into a plurality of groups, and the groups may be independently operated. The CCFLs receive substantially the same amount of power.

However, when luminance of the display panel of the display device having the direct illumination type backlight assembly is tested, luminances of an upper portion, a lower portion, a central portion, a left portion and a right portion are different from each other. Thus, display quality of the display panel is deteriorated.

Although the equal amount of power is applied to the CCFLs, non-uniformity of the backlight assembly may be caused by non-uniformity of the backlight assembly or structural irregularity of elements of the backlight assembly. However, adjusting luminances at various portions of the backlight assembly to compensate the non-uniformity is not easy, and the causes of the non-uniformity are not simple to identify.

SUMMARY

One or more embodiments of the present disclosure provide a method of driving light sources used for a flat panel display device, which is capable of improving luminance uniformity. The present disclosure also provides a device for driving light sources and a display device having the device for driving the light sources.

A method of driving light sources in accordance with one embodiment of the present disclosure is provided as follows. Power information is read based on position information on the light sources to output a light source control signal transmitting the power information. The power information determines the level of power applied to each of the light sources. Externally provided input power is changed into a plurality of driving powers having a level changed based on the light source control signal. The driving powers are applied to the light sources, respectively.

In various implementations, the light source control signal may be outputted by reading the power information through an Inter-Integrated Circuit (I2C) method and outputting the light source control signal through the I2C method. The externally provided input power may be changed into the plurality of driving powers by receiving the light source control signal through the I2C method, storing the power information that is transmitted through the received light source control signal, and changing the level of the input power based on the light source control signal transmitting the power information to output the driving powers.

A device for driving light sources in accordance with another embodiment of the present disclosure includes a first memory, a controlling part and a power dividing part. The first memory has power information for determining levels of driving powers applied to the light sources based on position of the light sources. The controlling part reads the power information from the first memory to output a light source control signal transmitting the power information. The power dividing part changes an externally provided input power into the driving powers having a level changed based on the light source control signal.

In various implementations, the light source control signal may include a digital control signal of I2C method. The power dividing part may include a second memory storing the power information transmitted by the light source control signal through the I2C method, and a level converting part changing the level of the input power based on the light source control signal transmitting the power information to output the driving powers. The level converting part may include a digital variable resistor changing a resistance based on the input power in accordance with the power information. The digital variable resistor may control a current level of the input power to output the driving powers. The digital variable resistor may control a voltage level of the input power to output the driving powers. The power information may include position information on the light sources and level information for determining a level of the power applied to each of the light sources.

A display device in accordance with still another embodiment of the present disclosure includes a display panel, a plurality of light sources, a driving circuit part and a power dividing part. The light sources provide the display panel with light. The driving circuit part includes a first memory and a timing controlling part. The first memory has driving information for driving the display panel and power information for determining levels of driving powers applied to the light sources based on position of the light sources. The timing controlling part outputs a panel driving signal for driving the display panel to the display panel based on the panel driving information, and reads the power information to output a light source control signal. The power dividing part applies the driving powers to the light sources. The driving powers have adjusted levels based on an externally provided input power and the light source control signal.

In various implementations, the timing controlling part may be electrically connected to the first memory and the power dividing part through an I2C method to output the light source control signal through the I2C method. The power dividing part may include a second memory storing the power information transmitted by the light source control signal received through the I2C method, and a level converting part changing the level of the input power based on the light source control signal transmitting the power information from the second memory to output the driving powers. The level converting part may include a resistor part and a selection signal generating part.

In various implementations, the resistor part may divide a current of the input power into a plurality of divided currents, and the selection signal generating part may select one of the divided currents based on the power information to output the selected current to one of the light sources as the driving power. The resistor part may divide a voltage of the input power into a plurality of divided voltages, and the selection signal generating part may select one of the divided voltages based on the power information to output the selected voltage to one of the light sources as the driving power.

In various implementations, each of the light sources may include a transforming part receiving one of the driving powers corresponding to the position of the light source to change a voltage level of the driving power, and a plurality of lamps providing the display panel with light based on the driving power having the changed voltage level. The lamps may be adjacent to each other. The display device may further include a plurality of power dividing parts corresponding to the light sources, respectively, and each of the power dividing parts may further include a transforming part changing a voltage level of the driving power to apply the driving power having the changed voltage level to each of the light sources.

In various implementations, the power information stored in the second memory may be volatilized when the input power is turned off. Alternatively, the power information stored in the second memory may be maintained although the input power is turned off.

In various implementations, the light sources may be extended in a first direction of a rear surface of the display panel and aligned in a second direction substantially perpendicular to the first direction. An amount of the driving power applied to the light source may be increased as a distance from a center of the rear surface of the display panel may be increased in the second direction.

According to various embodiments of a method of driving light sources used for a flat panel display device, a device for driving light sources and a display device having the device for driving the light sources of the present disclosure, luminance uniformity of the light sources may be improved so that display quality may be enhanced.

BRIEF DESCRIPTION OF THE DRAWINGS

The above and other advantages of the present disclosure will become more apparent by describing in detail example embodiments thereof with reference to the accompanying drawings, in which.

DETAILED DESCRIPTION

Figure 1:
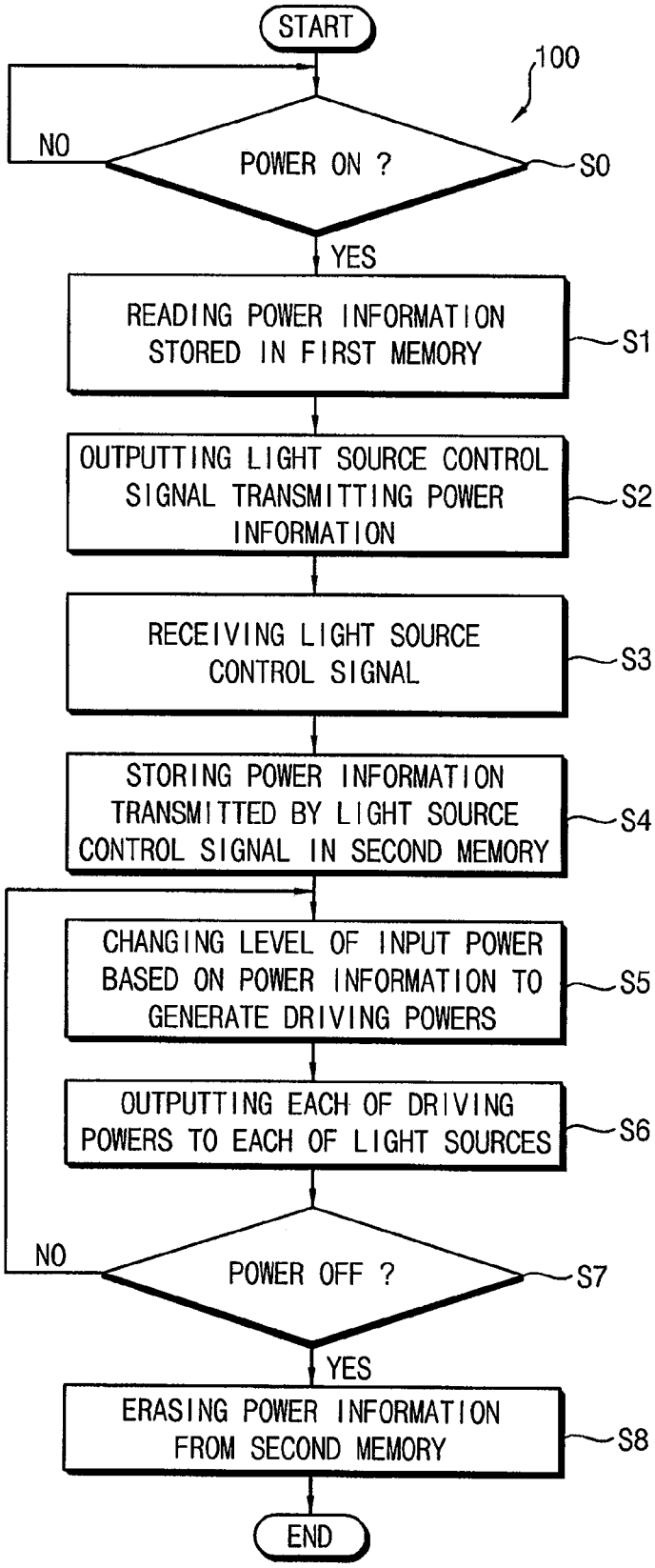
FIG. 1 is a flow chart illustrating a method of driving light sources in accordance with one embodiment of the present disclosure.

One or more embodiments are described in greater detail hereinafter with reference to the drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the present disclosure are described herein with reference to cross-section illustrations that are schematic illustrations of idealized embodiments (and intermediate structures) of the present disclosure. As such, variations from the shapes of the illustrations as a result, for example, of manufacturing techniques and/or tolerances, are to be expected. Thus, embodiments of the present disclosure should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present disclosure.

Unless otherwise defined, all terms (including technical and scientific terms) used herein have the same meaning as commonly understood by one of ordinary skill in the art to which this present disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. Hereinafter, the present disclosure will be described in detail with reference to the accompanying drawings.

FIG. 1 is a flow chart illustrating a method 100 of driving light sources in accordance with an embodiment of the present disclosure. Referring to FIG. 1, to drive light sources, power information including position information and level information is read. Level information determines a level of power applied to each of the light sources based on position information on the light sources. A level of externally provided input power is changed based on a light source control signal to generate a plurality of driving powers. The driving powers are applied to the light sources, respectively. The method of FIG. 1, including each of the process blocks S1-S6, is described in greater detail herein.

Figure 2:
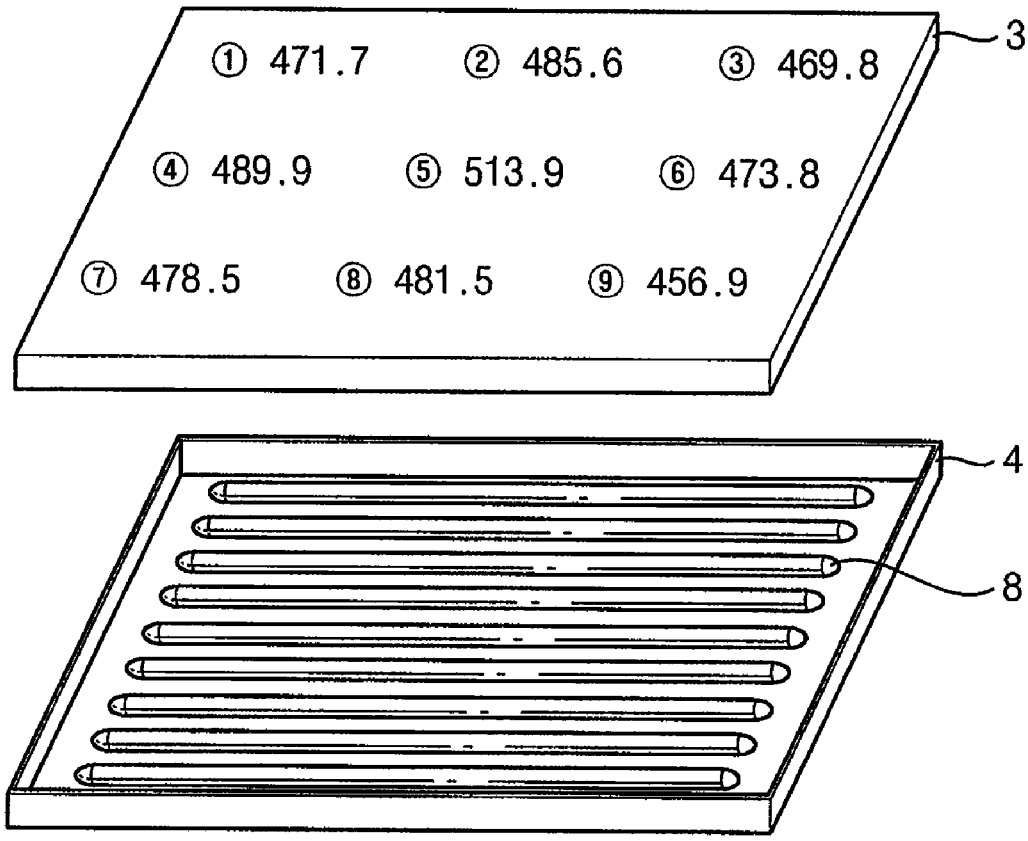
FIG. 2 is an exploded perspective view illustrating a display device having irregular luminance distribution in accordance with another embodiment of the present disclosure.

FIG. 2 is an exploded perspective view illustrating a display device having irregular luminance distribution in accordance with another embodiment of the present disclosure. In FIG. 2, an input power applied to a plurality of light sources is substantially equal to each other. Numbers of FIG. 2 represents luminance of a display panel having the light sources on a rear surface of the display panel when viewed on a plane. To drive the light sources, the power information is generated. Referring to FIG. 2, power information is luminance information on the light sources 8 disposed on the rear surface of a display panel 3 to receive input power having substantially the same level.

In one embodiment, when viewed on a plane, the display panel 3 has a substantially rectangular shape. An upper side corresponds to a longitudinal side on an upper portion of the rectangular shape. A lower side corresponds to a longitudinal side on a lower portion of the rectangular shape. A left side corresponds to a horizontal side on a left portion of the rectangular shape. A right side corresponds to a horizontal side on a right portion of the rectangular shape.

The light sources 8, in one embodiment, may be disposed on the rear surface of the display panel 3, and a longitudinal direction of the light sources may be substantially parallel with the horizontal side of the display panel 3. For example, the light sources 8 may include cold cathode fluorescent lamps (CCFL). Thus, the light sources 8 may be aligned along a horizontal direction of a backlight assembly 4.

When the same amount of power is applied to the light sources 8, luminances of the light sources 8 are substantially the same. However, when the light sources 8 are disposed on the rear surface of the display panel 3, the luminance on a central portion of the display panel 3 is greater than the luminance on an upper portion, a lower portion, a left portion and a right portion of the display panel 3.

The arrangement of the light sources 8 on the rear surface of the display panel 3 causes the irregularity of the luminance. For example, the central portion of the light sources 8 is surrounded by a remainder of the light sources 8. However, each of the upper portion, the lower portion, the left portion and the right portion of the light sources 8 is not surrounded by the remainder of the light sources 8. The irregularity of the luminance distribution may be predicted based on the arrangement of the light sources 8.

When the powers applied to the light sources 8 at different positions are different from each other, the luminance uniformity of the display panel 3 may be increased. For example, the light source 8 at the upper portion or the lower portion of the display panel 3 receives greater power than the light source 8 at the central portion of the display panel 3, the luminance uniformity of the display panel 3 may be increased although the luminances of the light sources 8 are different from each other.

In one embodiment, the power information includes the position information and the level information on each of the light sources 8. For example, the position information corresponds to sequential numbers of positions from the upper portion toward the lower portion of the display panel 3. The level information determines the power level of each of the light sources 8 based on the position information.

Figure 3:
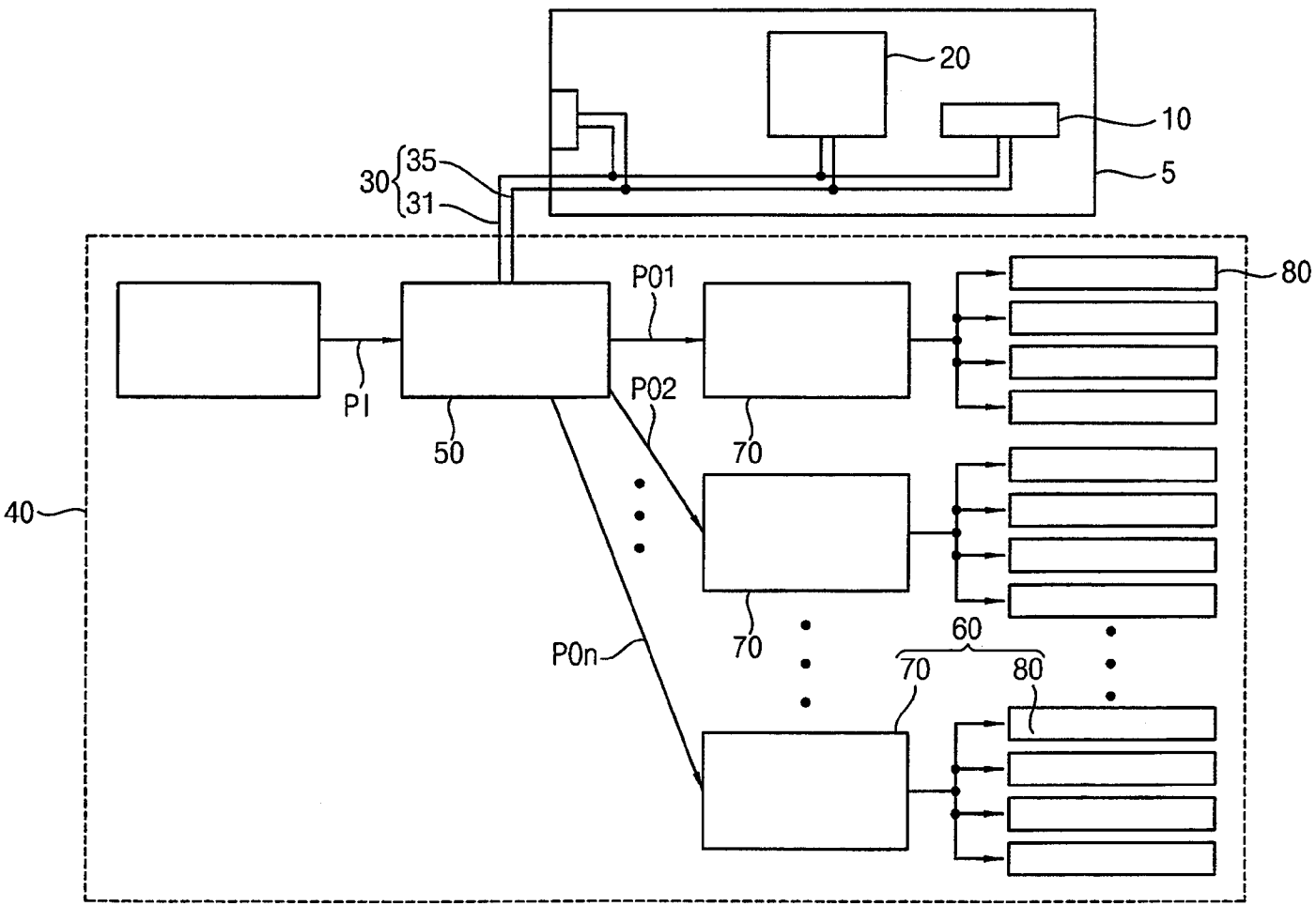
FIG. 3 is a block diagram illustrating a device for driving light sources in accordance with one embodiment of the present disclosure.

FIG. 3 is a block diagram illustrating a device for driving light sources in accordance with various embodiment of the present disclosure. Referring to FIGS. 1 and 3, once the power is determined to be on (block S0), the power information is read from a first memory component (block S1), and a light source control signal for transmitting power information based on the power information is outputted (block S2). In various implementations, reading power information and/or outputting a light source control signal may be performed by reading the power information through an Inter-Integrated Circuit (I2C) method and/or outputting the light source control signal through the I2C method.

Referring to FIG. 3, the I2C bus may include a controlling part 20 that is a protocol for a serial data transmission and an I2C bus line 30. A first one of the I2C bus line 30 is a serial data (SDA) line 35 that is a data bus line, and a second one of the I2C bus line 30 is a serial clock (SCL) line 31 that is a clock bus line. The SDA line 35 and the SCL line 31 are connected to an external device such as a memory, an analog-to-digital converter (ADC), a liquid crystal display (LCD) driver, a synthesizer, etc.

In various implementations, referring to FIGS. 1 and 3, the controlling part 20 may read the power information from a first memory 10 (block S1) through the I2C method to output the light source control signal. The light source control signal transmits the power information so that the light sources 60 receive different amounts of power. For example, the controlling part 20 selects a device for transmitting the power information to transmit the data frame having an identification (ID) code of the device for transmitting the power information through the SDA line 35, and maintains the SCL line 31 at a high level to transmit data to the device responding the ID code. The device for transmitting the power information and responding to the ID code may be a power dividing part 50. The data frame having the ID code may be the data frame of the power information. The light source control signal includes the data frame, which includes the ID code applied to the SDA line 35 and the power information, and a clock signal of a pulse type, which is applied to the SCL line 31.

The level of the input power PI that is externally provided is changed based on the light source control signal to generate the driving powers PO1, PO2, . . . , POn. For example, the light source control signal is received through the I2C interface including the SDA line 35 and the SCL line 31.

Figure 4:
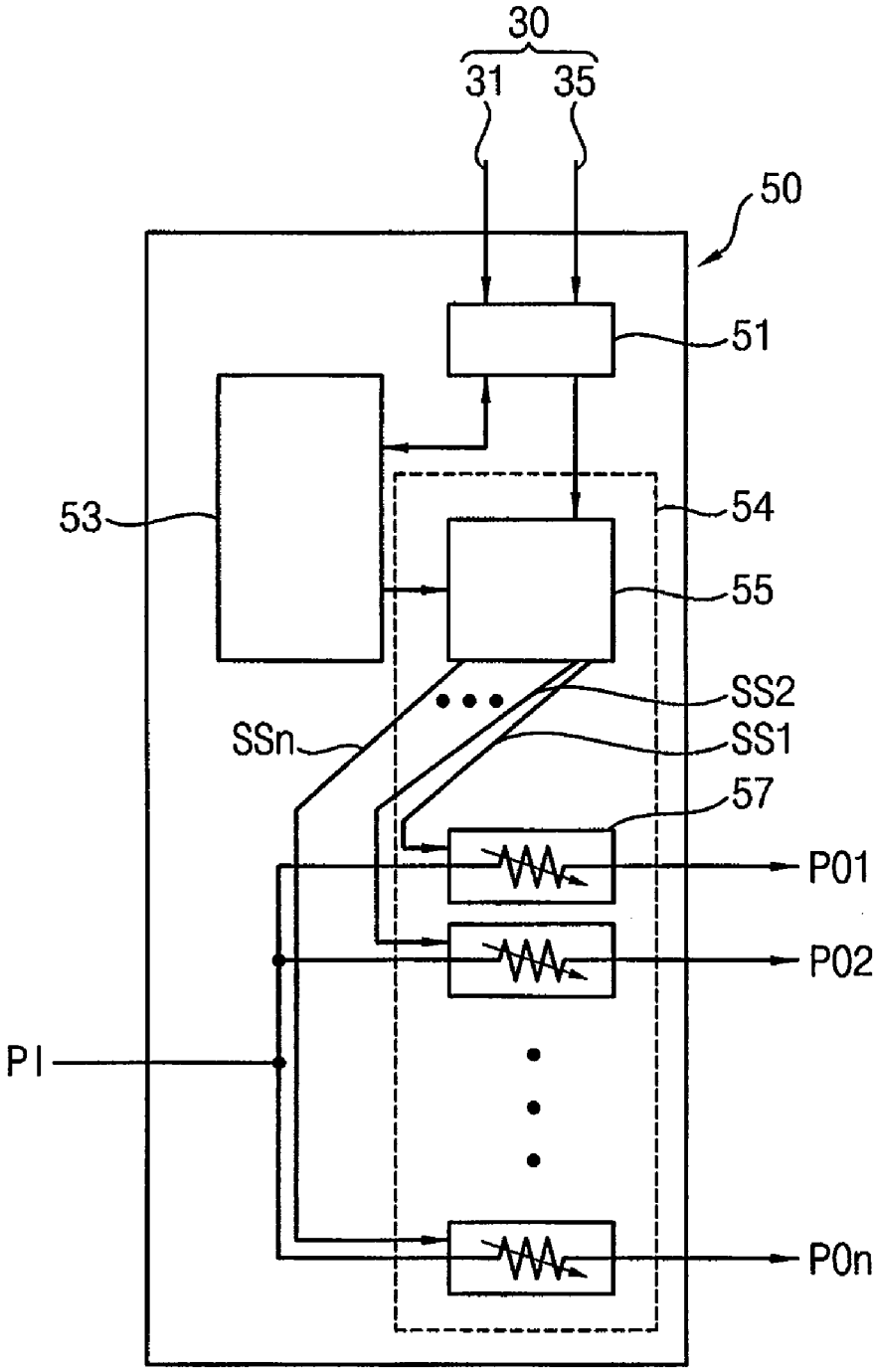
FIG. 4 is a block diagram illustrating a power dividing part shown in FIG. 3, in accordance with an embodiment of the present disclosure.

The power information that is transmitted based on the light source control signal is stored in a second memory 53 (block S4). The second memory 53 is shown in FIG. 4, and further description is provided herein in reference thereto. The power information includes a digital control signal, and may be a seven-bit signal based on the number of scales of the levels applied to the light sources 60. Alternatively, the number of the bits of the power information may be less than or more than seven.

The light source control signal is received and the level of the input power PI is changed based on the power information (block S5). The input power PI may be a current or a voltage. For example, the level of the input power PI of the current is changed to output the driving powers PO1, PO2, . . . , POn having different levels. Alternatively, the level of the input power PI of the voltages may be changed to output the driving powers PO1, PO2, . . . , POn having different levels. For example, variable resistors may be used to change the level of the input power PI. Electric power is substantially proportional to a square of a current. Thus, when the levels of the current or the voltage of the input power PI are changed, the driving powers PO1, PO2, . . . , POn may be different from each other.

The driving powers PO1, PO2, . . . , POn are outputted to the light sources 60, respectively (block S6). Referring to FIG. 3, each of the light sources 60 may include a transforming part 70 and a plurality of lamps 80. For example, each of the driving powers PO1, PO2, . . . , POn is transformed by the transforming part 70, and the transformed driving power is applied to the lamps 80. When the input power PI is opened, the power information may be volatilized in the second memory 53. Alternatively, the power information may be maintained in the second memory 53 until the changed power information is received, although the input power PI is opened. Therefore, the levels of the powers are changed based on the position of the light sources 60 through the digitalization, so that the uniformity of the luminance distribution on the display panel may be improved.

Next, in one implementation, a decision is made as to whether power is off (block S7). If power is not off, then the process flow returns to change the level of input power (block S5) and to output the driving powers to the light sources (block S6). Otherwise, if the power is off, the power information is erased from the second memory 53 (block S8).

Hereinafter, the device 100 for driving the light sources are explained in detail in reference to FIG. 3. Referring to FIG. 3, the device 100 for driving the light sources includes the first memory 10, the controlling part 20 and the power dividing part 50.

The device 100 for driving the light sources drives the light sources 60, and controls the levels of the driving powers based on the position of the light sources 60 through the digitalization. When the device 100 for driving the light sources is used for the backlight of the display device, the first memory 10 and the controlling part 20 may be mounted on a driving substrate 5 for driving the display panel. The power dividing part 50 may be on an inverter 40 for driving the light sources 60.

The first memory 10 stores the power information. The power information determines levels of the driving powers applied to the light sources 60 based on the position of the light sources 60. For example, the power information includes the position information on each of the light sources 60, and the level information that determines the level of the powers applied to the light sources 60. Any repetitive explanation concerning the position information and the level information will be omitted.

The first memory 10 may include an electrically erasable programmable read-only memory (EEPROM). Thus, the power information is not erased although the power is not applied to the EEPROM. Also, the EEPROM may be programmed by an external device to store new data.

The controlling part 20 reads the power information from the first memory 10 to output the light source control signal that transmits the power information. The controlling part 20 may be a timing controlling part that outputs panel driving signals for driving the display panel. The controlling part 20 is electrically connected to the first memory 10 through the I2C interface method to read the power information and to output the light source control signal that transmits the power information. The light source control signal is a digital control signal of the I2C interface type, and is transmitted through the I2C bus line 30 including the SDA line 35 and the SCL line 31. Any further repetitive explanation concerning the I2C bus line 30 will be omitted.

FIG. 4 is a block diagram illustrating one embodiment of the power dividing part 50, as shown in FIG. 3. Referring to FIG. 4, the power dividing part 50 changes the level of the externally provided input power based on the light source control signal to output the driving voltages having the changed levels to the light sources 60, respectively. In one embodiment, the power dividing part 50 may include an interface part 51, the second memory 53 and a level converting part 54.

The interface part 51, in one embodiment, is electrically connected to the controlling part 20 through the I2C method. The interface part 51 receives the light source control signal from the controlling part 20 through the SDA line 35 and the SCL line 31. The second memory 53 stores the power information transmitted through the light source control signal received from the interface part 51. The second memory 53 may include a RAM type memory or a ROM type memory. When the second memory 53 is the RAM type memory, the power information is volatilized by turning off the input power, and the power information is retransmitted to the second memory 53 from the controlling part 20 by turning on the input power. Alternatively, when the second memory 53 is the ROM type memory, the power information is maintained in the second memory 53 although the input power is turned off. For example, when the second memory 53 is the EEPROM, the power information stored in the second memory 53 may be updated by an external device.

The level converting part 54, in one embodiment, changes the levels of the input power PI in response to the light source control signal based on the power information to output the driving powers PO1, PO2, . . . , POn. The level converting part 54 may include a selection signal generating part 55 and a digital variable resistor 57.

The selection signal generating part 55, in one embodiment, generates selection control signals SS1, SS2, . . . , SSn based on the power information transmitted to the second memory 53 and the light source control signal received from the interface part 51. The selection control signals SS1, SS2, . . . , SSn may be the digital signals, and may include information for selecting a predetermined channel from a plurality of selection channels electrically connected to the variable resistors 57, respectively.

Figure 5:
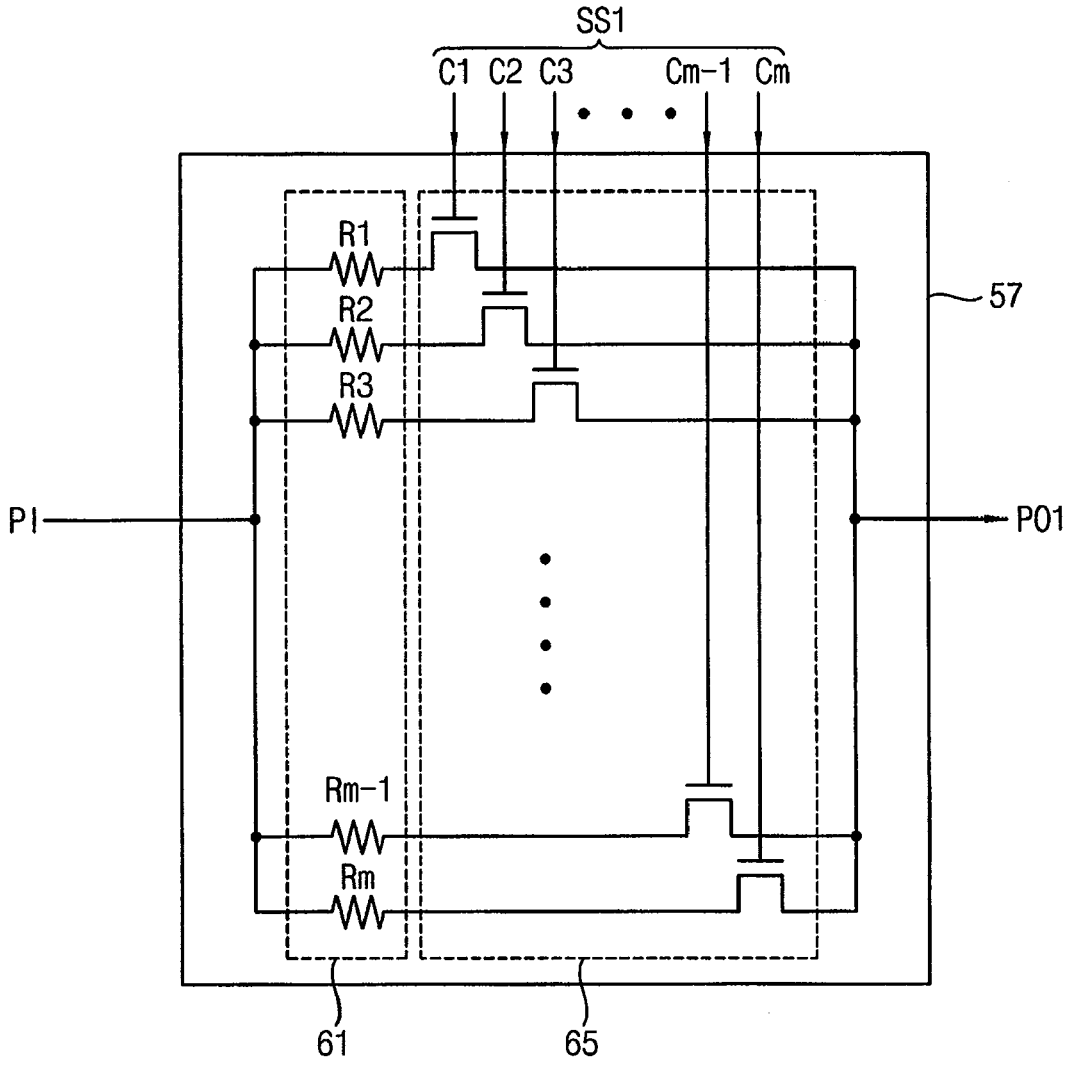
FIG. 5 is a circuit diagram illustrating a digital variable resistor shown in FIG. 4, in accordance with an embodiment of the present disclosure.

FIG. 5 is a circuit diagram illustrating one embodiment of the digital variable resistor 57, as shown in FIG. 4. The digital variable resistor 57 will be described with reference to FIG. 5. It is evident, however, that many alternative modifications and variations will be apparent to those having skill in the art in light of the foregoing description. The digital variable resistor 57 changes the level of the input power PI to output the powers having the changed levels. In FIG. 5, the digital variable resistor 57 changes the levels of the current of the input power PI. The digital variable resistor 57 may include a resistor part 61 and a selection output part 65.

The resistor part 61 includes a plurality of resistors R1, R2, . . . , Rm having different resistances. The resistors R1, R2, . . . , Rm are electrically connected to each other in parallel. The voltage of the input power PI is equally applied to the resistors R1, R2, . . . , Rm. Therefore, the current of the input power PI is divided into the resistors R1, R2, . . . , Rm, and the divided currents applied to the resistors R1, R2, . . . , Rm are different from each other.

The selection output part 65 includes a plurality of switching elements electrically connected to the resistors R1, R2, . . . , Rm, respectively. Each of the switching elements is electrically connected to the selection channel of the selection signal generating part 55. The selection control signal is applied to the gate electrode of the switching elements through the selection channels. Thus, the gate electrode of a selected switching element is turned on to output the driving power having the changed current level through the selected switching element. Therefore, the driving voltages PO1, PO2, . . . , POn having different current levels are outputted through the digital variable resistors 57. In one implementation, a plurality of light sources 60 may be electrically connected to one power dividing part 50.

Figure 6:
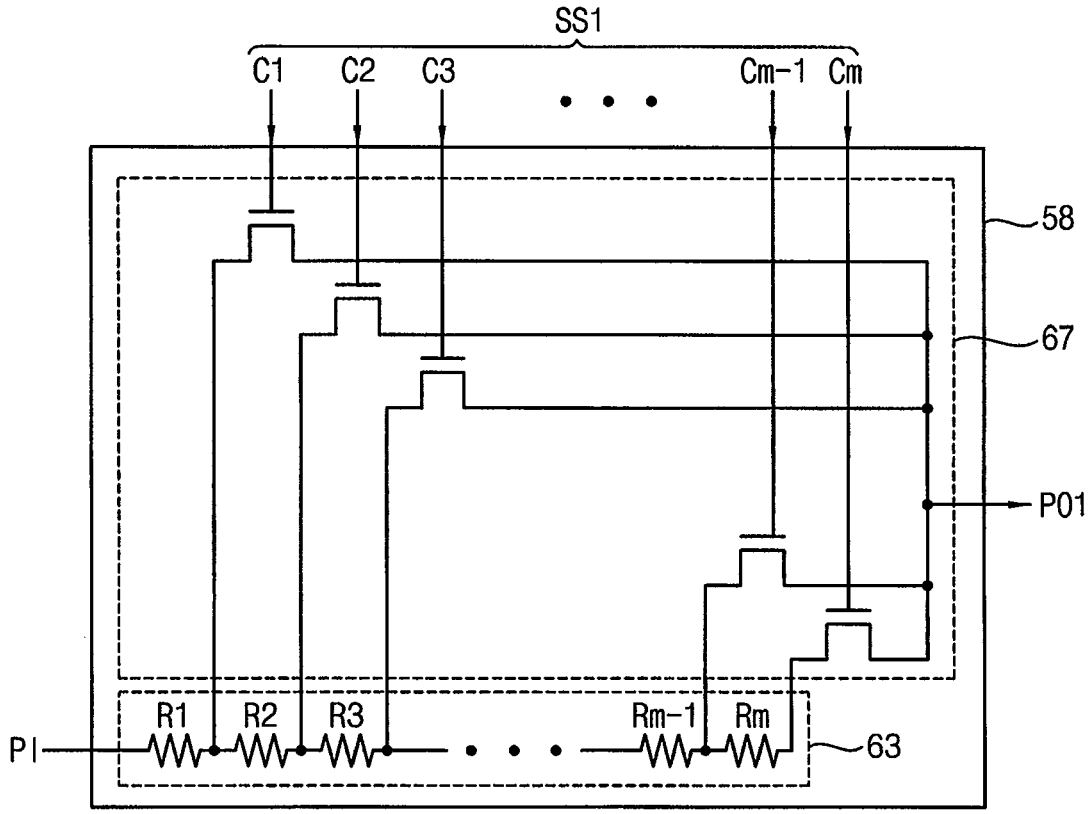
FIG. 6 is a circuit diagram illustrating a variable resistor in accordance with another embodiment of the present disclosure.

FIG. 6 is a circuit diagram illustrating a variable resistor in accordance with another embodiment of the present disclosure. Referring to FIG. 6, the digital variable resistor 58 changes the voltage level of the input power PI. The digital variable part 58 includes a resistor part 63 and a selection output part 67.

In one embodiment, the resistor part 63 includes a plurality of resistors R1, R2, . . . , Rm having different resistances. The resistors R1, R2, . . . , Rm are electrically connected to each other in serial. The voltage of the input power PI is divided into the resistors R1, R2 . . . , Rm, and the divided voltages applied to the resistors R1, R2, . . . , Rm are different from each other.

In one embodiment, the selection output part 67 includes a plurality of switching elements electrically connected between the resistors R1, R2, . . . , Rm. Each of the switching elements is electrically connected to the selection channel of a selection signal generating part 55. The selection control signal is applied to the gate electrode of the switching elements through the selection channels. Thus, the gate electrode of a selected switching element is turned on to output the driving power having the changed voltage level through the selected switching element. Therefore, the driving voltages PO1, PO2, . . . , POn having different voltage levels are outputted through the digital variable resistors 58.

Figure 7:
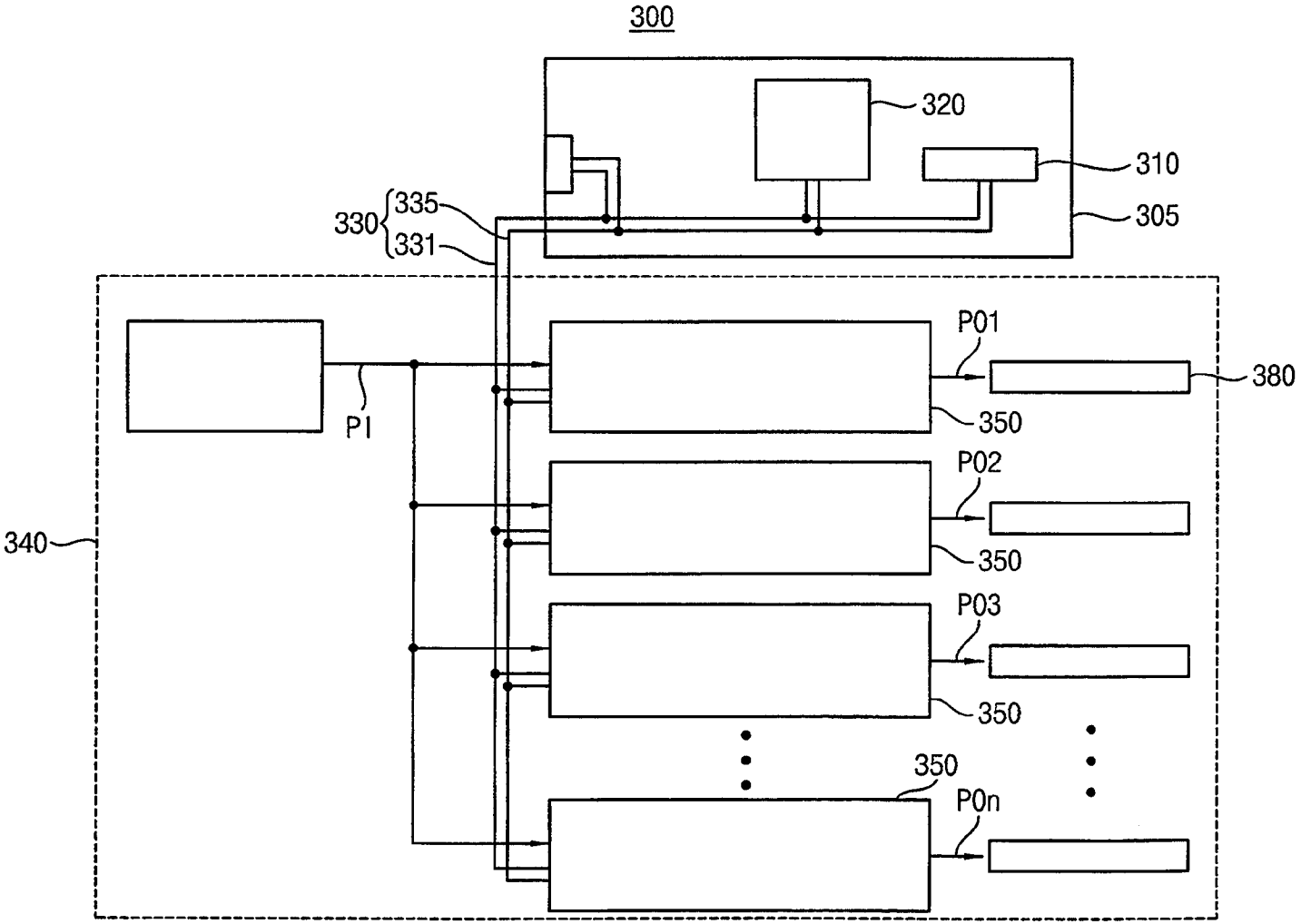
FIG. 7 is a block diagram illustrating a device for driving light sources in accordance with another embodiment of the present disclosure.
Figure 8:
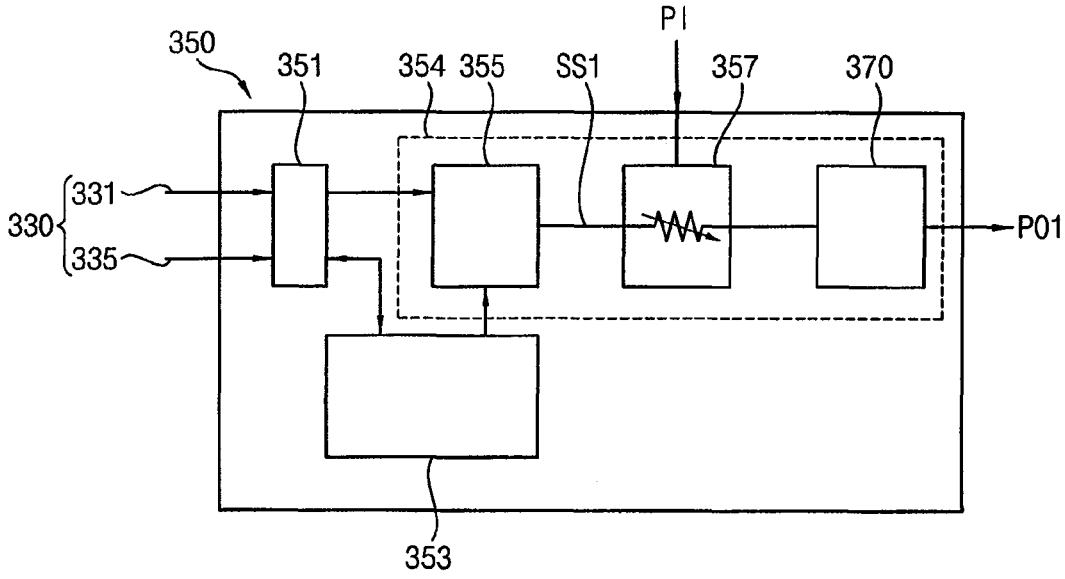
FIG. 8 is a clock diagram illustrating a power dividing part shown in FIG. 7, in accordance with an embodiment of the present disclosure.

FIG. 7 is a block diagram illustrating a device for driving light sources in accordance with another embodiment of the present disclosure. FIG. 8 is a clock diagram illustrating a power dividing part shown in FIG. 7.

Referring to FIGS. 7 and 8, the device 300 for driving the light sources includes a first memory 310, a controlling part 320 and a power dividing part 350. The device for driving the light sources of FIGS. 7 and 8 is same as in FIGS. 3 to 6 except the power dividing part 350. Thus, the same reference numerals will be used to refer to the same or like parts as those described in FIGS. 3 to 6 and any further explanation concerning the above elements will be omitted.

In one embodiment, the device 300 for driving the light sources includes a plurality of power dividing parts 350. The power dividing parts 350 are electrically connected to a plurality of light sources 380, respectively. Each of the power dividing parts 350 includes an interface part 351, a second memory 353, a level converting part 354 and a transforming part 370. The power dividing parts 350 of FIGS. 7 and 8 are substantially the same as the power dividing part 50 of FIG. 4 except the level converting part 354 and the transforming part 370. Thus, any further explanation concerning the above elements will be omitted.

In FIGS. 7 and 8, the level converting part 354 may include one digital variable resistor 357. The digital variable resistor 357 may be substantially the same as the digital variable resistors 57 and 58 shown in FIGS. 5 and 6. The transforming part 370 changes a voltage level of driving power outputted from the digital variable resistor 357 to apply the driving power having the changed voltage level to the light sources 380.

Figure 9:
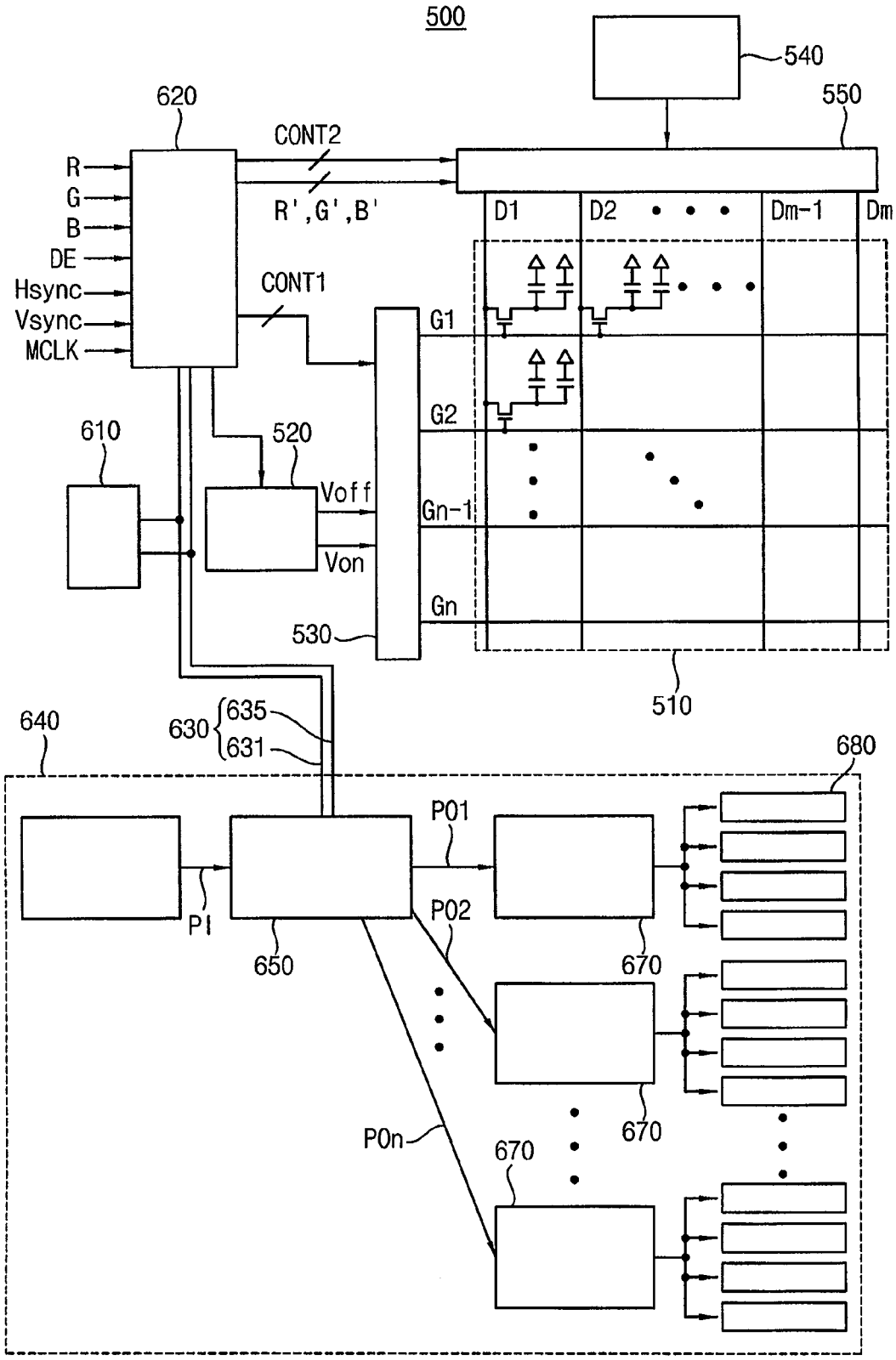
FIG. 9 is a block diagram illustrating a display device in accordance with another embodiment of the present disclosure.

FIG. 9 is a block diagram illustrating a display device in accordance with another embodiment of the present disclosure. Referring to FIG. 9, the display device 500 includes a display panel 510, a plurality of light sources 660, a driving circuit part and a power dividing part 650. The display panel 510 includes a lower substrate, an upper substrate (not shown) facing the lower substrate and a liquid crystal layer (not shown) interposed between the lower substrate and the upper substrate.

The lower substrate includes a plurality of gate lines G1, . . . Gn, a plurality of data lines D1, . . . Dm, a plurality of pixels and a plurality of switching elements. The gate lines G1, . . . Gn are extended in a longitudinal direction of the display panel 510. The data lines D1, . . . Dm are extended in a horizontal direction of the display panel 510. The pixels and the switching elements are electrically connected to the gate and data lines G1, . . . , Gn, D1, . . . Dm, and are arranged in a matrix shape. A control electrode and an input electrode of each of the switching elements are electrically connected to one of the gate lines G1, . . . Gn and one of the data lines D1, . . . Dm, respectively. An output electrode of each of the switching electrodes is electrically connected to each of the pixels. The lower substrate may further include a gate driving part 530 and a data driving part 550. The gate driving part 530 and the data driving part 550 will be explained later.

The upper substrate may include a color filter (not shown) corresponding to each of the pixels and a common electrode (not shown). When an externally provided input power PI is applied to the light sources 660, the light sources 660 generate light to provide a rear surface of the display panel 510 with the light. The light sources 660 are described in greater detail herein.

In various implementations, the driving circuit part may include a driving voltage generating part 520, a gamma voltage generating part 540, a first memory 610 and a timing controlling part 620. The driving voltage generating part 520, the gamma voltage generating part 540, the timing controlling part 620 and the first memory 610 may be integrated on one driving substrate. The driving voltage generating part 520 generates various driving voltages such as a gate-on voltage Von, a gate-off voltage Voff, a common voltage VCOM, etc.

In various implementations, the gamma voltage generating part 540 may generate a pair of gamma voltages corresponding to light transmittance of each of the pixels. A first voltage of the gamma voltages has a positive polarity, and a second voltage of the gamma voltages has a negative polarity. The positive polarity is opposite to the negative polarity with respect to the common voltage, and the first and second voltages alternate during an inversion driving to be applied to the display panel 510. The gate driving part 530 is electrically connected to the gate lines of the display panel 510 to apply gate signals having the gate-on voltage and the gate-off voltage to the gate lines.

In various implementations, the data driving part 550 is electrically connected to the data lines of the display panel 510 to generate a plurality of gray-scale voltages based on a plurality of gamma voltages from the gamma voltage generating part 540. The gray-scale voltages are applied to the pixels as data signals. The first memory 610 stores panel driving information and power information. The panel driving information that is a default data includes information on the gamma voltages, timing information on application of the gate and data signals, etc. The power information determines the level of the powers applied to the light sources 660 based on the location of the light sources 660. For example, the location of the light sources 660 may be divided portions of an upper portion, a central portion and a lower portion of the display panel 510. The power information of FIG. 9 is substantially the same as in FIGS. 3 to 6. Thus, any repetitive explanation concerning the above elements will be omitted.

In various implementations, the timing controlling part 620 generates a panel control signal for controlling operation of the gate driving part 530 and the data driving part 550 based on the panel driving information to apply the panel control signal to the gate driving part 530 and the data driving part 550. The timing controlling part 620 receives image signals R, G and B, an input control signal for controlling display of the image signals R, G and B from an externally provided graphic controller. For example, the input control signal may include a vertical synchronizing signal Vsync, a horizontal synchronizing signal Hsync, a main clock MCLK, a data enable signal DE, etc. The timing controlling part 620 generates a gate control signal CONT1 and a data control signal CONT2 based on the input control signal, and processes the image signals R, G and B with respect to the operation of the display panel 510. The timing controlling part 620 applies the gate control signal to the gate driving part 530 and applies the data control signal and the processed image signals R', G' and B' to the data driving part 550.

In various implementations, the timing controlling part 620 reads the power information from the first memory 610 through the I2C method to output the light source control signal that transmits the power information through the I2C method. The timing controlling part 620 selects the power dividing part 650 to transmit a data frame having an identification (ID) code of the power dividing part 650 through an SDA line 635, and maintains an SCL line 631 at a high level to transmit the power information to the power dividing part 650 responding to the ID code. The data frame having the ID code of the power dividing part 650 may be a data frame of the power information.

The power dividing part 650 outputs a plurality of driving powers PO1, PO2, . . . , POn having changed levels based on externally provided input power PI and the light source control signal. The power dividing part 650 of FIG. 9 may be substantially the same as the power dividing part 50 of FIG. 4.

In FIG. 9, each of the light sources 660 includes a transforming part 670 and a plurality of lamps 680.

The transforming part 670 receives one of the driving powers PO1, PO2, . . . , POn outputted from the level converting part, which corresponds to one of the light sources 660. The transforming part 670 changes the level of the driving power to apply the driving power to the lamps 680. Thus, the lamps 680 electrically connected to the transforming part 670 receive substantially the same amount of power.

In FIG. 9, the display device 500 includes the plurality of the light sources 660. Thus, the display device 500 includes a plurality of transforming parts 670, and the lamps 680 are connected to each of the transforming parts 670. The lamps 680 connected to each of the transforming parts 670 are adjacent to each other.

The driving powers PO1, PO2, . . . , POn having different levels are applied to the transforming parts 670, respectively. The driving power applied to the lamps 680 on an upper portion and a lower portion of the rear surface of the display panel 510 is greater than the driving power applied to the lamps 680 on a central portion of the rear surface of the display panel 510. Thus, the uniformity of the luminance distribution of the display panel 510 is increased.

Figure 10:
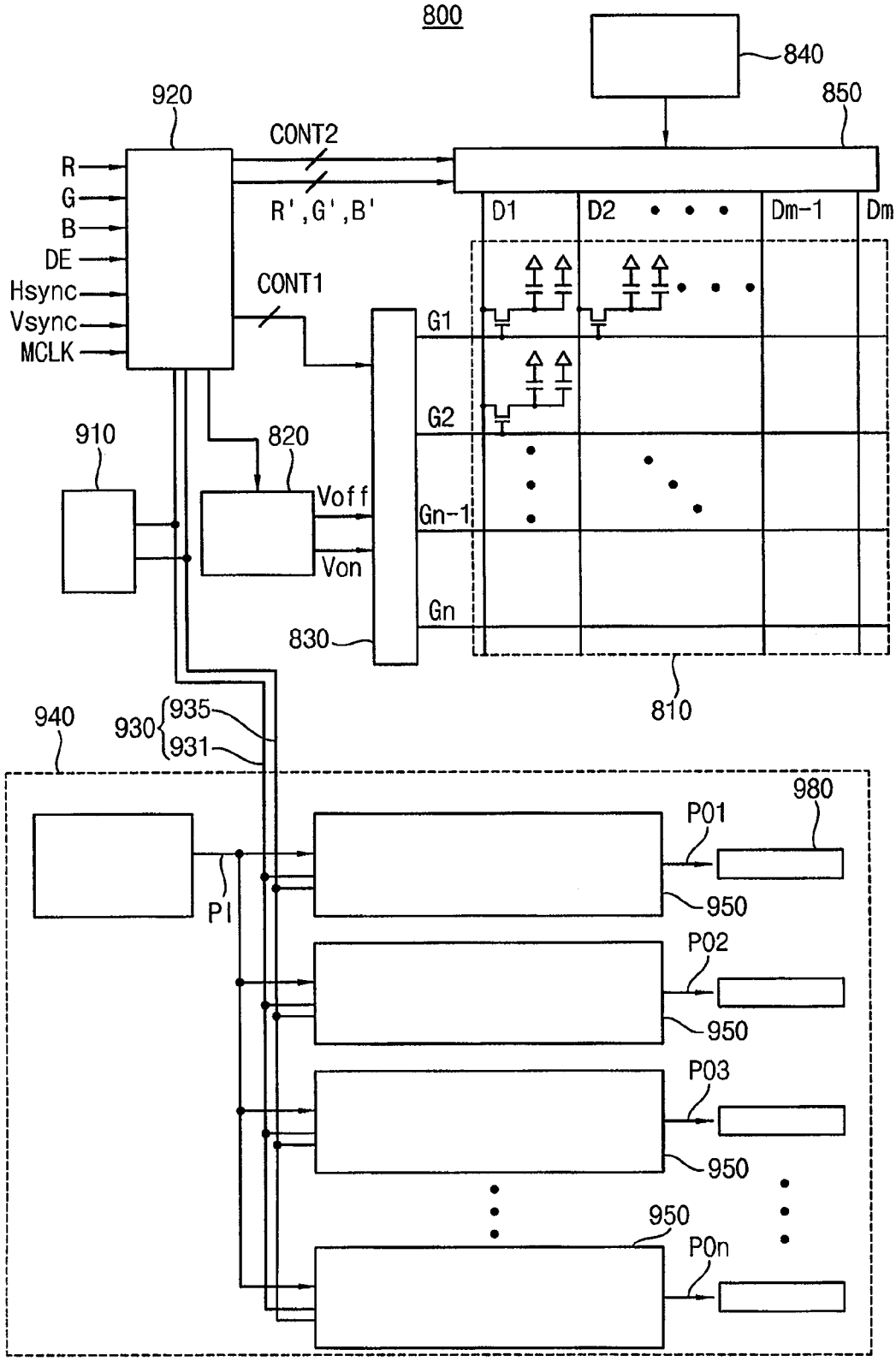
FIG. 10 is a block diagram illustrating a display device in accordance with still another embodiment of the present disclosure.

FIG. 10 is a block diagram illustrating a display device in accordance with still another embodiment of the present disclosure. Referring to FIG. 10, the display device 800 includes a display panel 810, a plurality of light sources 980, a driving circuit part and a plurality of power dividing part 950. The display device 800 of FIG. 10 is same as in FIG. 9 except the light sources 980 and the power dividing parts 950. Thus, the same reference numerals will be used to refer to the same or like parts as those described in FIG. 9 and any further explanation concerning the above elements will be omitted.

For example, each of the power dividing parts 950 of FIG. 10 may be same as in FIG. 9, and may include an interface part, a second memory and a level converting part. The level converting part may include a selection signal generating part, a digital variable resistor and a transforming part. The display device 800 includes the power dividing parts 950 electrically connected to the light sources 980, respectively. For example, each of the light sources 980 may include one lamp. Thus, driving power applied to the lamps 980 with respect to position of the lamps 980 may be controlled through a digitalization method.

In various implementations, the lamps 980 may be extended in a first direction that is a longitudinal direction of the display panel 810, and may be aligned in a second direction that is substantially perpendicular to the first direction.

The lamps 980 are on a rear surface of the display panel 810. For example, an amount of the driving power applied to the lamps 980 may be increased in the second direction, as a distance from the center of the rear surface of the display panel 810 is increased in the second direction.

According to a method of driving light sources, a device for driving light sources and a display device having the device for driving the light sources of the present disclosure, luminance uniformity of the light sources is enhanced so that display quality may be improved. The method of driving the light sources, the device for driving the light sources and the display device having the device for driving the light sources may be used for a backlight assembly of a flat panel display device.

This invention has been described with reference to the example embodiments. It is evident, however, that many alternative modifications and variations will be apparent to those having skill in the art in light of the foregoing description. Accordingly, the present disclosure embraces all such alternative modifications and variations as falling within the spirit and scope of the appended claims.

What is claimed is:

1. A machine-implemented method for driving a plurality of differently positioned light sources of a backlighting system of a display unit where, as positionally sensed at a front side of the display unit, spatial distribution of luminance provided by the backlighting system versus power input for two or more of the light sources can vary, the method comprising:

obtaining position and power level information signals indicating respective positions of each of two or more of the differently positioned light sources and indicating corresponding power levels to be delivered to each of the two or more differently positioned ones of the light sources based on the respective positionings within the backlighting system of the two or more differently positioned light sources;

outputting a light source control signal providing control information corresponding to that of the obtained position and power level information signals;

receiving an externally provided input power and subdividing the received input power into a plurality of respective driving powers each respectively having a driving power level whose magnitude is based on the corresponding position and power level information provided by the light source control signal; and applying each of the respective driving powers respectively to the two or more differently positioned light sources;

wherein the obtained position and power level information signals are configured to reduce non-uniformity of luminance as positionally sensed across the front side of the display unit, and wherein the light sources are extended in a first direction of a rear surface of the display panel and aligned in a second direction substantially perpendicular to the first direction, and an amount of the driving power applied to the light source is increased as a distance from a center of the rear surface of the display panel is increased in the second direction.

2. The method of claim 1, wherein the outputting of the light source control signal includes using an Inter-Integrated Circuit (I2C) method for outputting the light source control signal.

3. The method of claim 2, wherein the externally provided input power is changed into the respective driving powers by a process of:

receiving the light source control signal through the I2C method;

storing the power indicating information that is conveyed by the received light source control signal; and setting the driving power level of a respective driving power to be an adjusted portion of the input power based on the respective power indicating information that is conveyed by the received light source control signal.

4. A device for driving a plurality of differently positioned light sources of a backlighting system of a display unit where, as positionally sensed at a front side of the display unit, spatial distribution of luminance provided by the backlighting system versus power input for two or more of the light sources can vary, the device comprising:

a first memory having position and power indicating information stored therein for indicating levels of respective driving powers to be applied to the light sources based on positions of the light sources within the backlighting system;

a controlling part configured for reading the position and power indicating information from the first memory and for outputting a light source control signal transmitting the position and power indicating information; and a power dividing part coupled to the controlling part and configured for subdividing an externally provided input power into respective driving powers having respective levels based on the position and power indicating information transmitted to the power dividing part by the light source control signal, wherein the light sources are extended in a first direction of a rear surface of the display panel and aligned in a second direction substantially perpendicular to the first direction, and an amount of the driving power applied to the light source is increased as a distance from a center of the rear surface of the display panel is increased in the second direction.

5. The device of claim 4, wherein the light source control signal comprises a digital control signal of I2C method.

6. The device of claim 5, wherein the power dividing part comprises:

a second memory capable of storing the position and power indicating information transmitted by the light source control signal through the I2C method; and a level converting part capable of changing the level of the input power into the subdivided driving powers based on the power indicating information.

7. The device of claim 6, wherein the level converting part comprises a digital variable resistor.

8. The device of claim 7, wherein the digital variable resistor is configured to control a current level of at least one of the driving powers.

9. The device of claim 7, wherein the digital variable resistor is configured to control a voltage level of at least one of the driving powers.

10. The device of claim 4, wherein the position and power indicating information comprises position information indicating relative positionings for the light sources and level information for determining a level of the power applied to each of the differently positioned light sources.

11. A display device comprising:

a display panel;

backlighting unit having a plurality of light sources positioned therein, the backlighting unit being configured for providing the display panel with light;

a driving circuit part including:

a first memory having driving information stored therein for driving the display panel and position and power indicating information stored therein for determining levels of driving powers to be applied to the light sources based on the positions of the light sources; and a timing controlling part configured for outputting to the display panel, a panel driving signal for driving the display panel based on the panel driving information, and configured for reading from the first memory, the position and power indicating information and configured for outputting a corresponding light source control signal; and a power dividing part, coupled to receive the light source control signal and configured to respectively supply different driving powers to the respectively positioned light sources, the driving powers having adjusted levels based on an externally provided input power and based on the positions of the respectively positioned light sources as such correspond to the position and power information indicated by the received light source control signal, wherein the light sources are extended in a first direction of a rear surface of the display panel and aligned in a second direction substantially perpendicular to the first direction, and an amount of the driving power applied to the light source is increased as a distance from a center of the rear surface of the display panel is increased in the second direction.

12. The display device of claim 11, wherein the timing controlling part is electrically connected to the first memory and the power dividing part through an I2C method to output the light source control signal through the I2C method.

13. The display device of claim 12, wherein the power dividing part comprises:

a second memory capable of storing the power information transmitted by the light source control signal received through the I2C method; and a level converting part configured for changing the level of the input power based on the light source control signal transmitting the power information from the second memory to output the driving powers.

14. The display device of claim 13, wherein the level converting part comprises:

a resistor part configured for dividing a current of the input power into a plurality of divided currents; and a selection signal generating part configured for selecting one of the divided currents based on the power information to output the selected current to one of the light sources as the driving power.

15. The display device of claim 13, wherein the level converting part comprises:

a resistor part configured for dividing a voltage of the input power into a plurality of divided voltages; and a selection signal generating part configured for selecting one of the divided voltages based on the power information to output the selected voltage to one of the light sources as the driving power.

16. The display device of claim 13, wherein each of the light sources comprises:

a transforming part configured for receiving one of the driving powers corresponding to the position of the light source to change a voltage level of the driving power; and a plurality of lamps positioned for providing the display panel with light based on the driving power having the changed voltage level, the lamps being adjacent to each other.

17. The display device of claim 13, further comprising a plurality of power dividing parts corresponding to the light sources, respectively, each of the power dividing parts further including a transforming part changing a voltage level of the driving power to apply the driving power having the changed voltage level to each of the light sources.

18. The display device of claim 13, wherein the power information stored in the second memory is volatilized when the input power is turned off.

19. The display device of claim 13, wherein the power information stored in the second memory is maintained although the input power is turned off.

20. The display device of claim 1, wherein the light sources are substantially the same in terms of luminance output in response to power input.

* * * * *